US005392797A

United States Patent [19]

Welch

[11] Patent Number: 5,392,797

[45] Date of Patent: Feb. 28, 1995

[54] SINGLE MOTIVE PUMP, CLEAN-IN-PLACE SYSTEM, FOR USE WITH PIPING SYSTEMS AND WITH VESSELS

[75] Inventor: Elmer S. Welch, Silver Lake, Wis.

[73] Assignee: VQ Corporation, Silver Lake, Wis.

[21] Appl. No.: 209,447

[22] Filed: Mar. 10, 1994

[51] Int. Cl.[6] ..... B08B 9/08

[52] U.S. Cl. ..... 134/108; 134/95.3; 134/109; 134/169 R

[58] Field of Search ..... 134/95.1, 95.3, 103.1, 134/108, 109, 168 R, 168 C, 169 R, 169 A, 169 C

[56] References Cited

U.S. PATENT DOCUMENTS

| | | | |
|---|---|---|---|
| 3,378,018 | 4/1968 | Lawter | 134/109 |
| 3,448,745 | 6/1969 | Seeley | 134/169 R X |
| 3,502,215 | 3/1970 | Cahan | 134/109 X |
| 3,575,729 | 4/1971 | Howard | 134/168 R |
| 3,719,191 | 3/1973 | Zimmerly | 134/168 R X |
| 4,481,086 | 11/1984 | Bianchi et al. | 134/95.3 X |
| 4,895,603 | 1/1990 | Semp et al. | 134/169 R X |
| 5,107,874 | 4/1992 | Flanigan et al. | 134/109 X |

FOREIGN PATENT DOCUMENTS

| | | | |
|---|---|---|---|
| 761035 | 9/1980 | U.S.S.R. | 134/109 |

*Primary Examiner*—Philip R. Coe

*Attorney, Agent, or Firm*—Dressler, Goldsmith, Shore, & Milnamow, Ltd.

[57] ABSTRACT

A single motive pump, clean-in-place system is disclosed for use with an associated piping system and with a vessel to be cleaned of contaminating material. The system comprises a recirculation loop, a return line from the vessel to the recirculation loop, and a feed line from the recirculation loop to the vessel. During a wash recirculation cycle, the system uses a single motive pump to provide recirculation flow, feed flow, and, via an eductor pump, return suction from the vessel. An alternate embodiment of the clean-in-place system uses a water storage tank when adequate water flow rate or supply pressure are unavailable.

6 Claims, 2 Drawing Sheets

SINGLE MOTIVE PUMP, CLEAN-IN-PLACE SYSTEM, FOR USE WITH PIPING SYSTEMS AND WITH VESSELS

FIELD OF THE INVENTION

This invention pertains to cleaning systems for in-place cleaning of piping systems and of vessels. More particularly, this invention pertains to clean-in-place systems which utilize a single motive pump both for liquid supply and for liquid return from the system or vessel being cleaned during wash recirculation.

BACKGROUND OF THE INVENTION

Process vessel and piping system cleanliness, in many industries, is governed by strict regulatory requirements and standards. In certain industries, such as the food processing, dairy, and pharmaceutical industries, vessel cleaning and system cleaning must be performed regularly or daily to maintain sanitary standards and to meet strict regulatory requirements. In addition, in these, as well as other industries, vessels and piping systems may also require cleaning to permit maintenance on the vessels or systems, or subsequent to maintenance thereon.

To meet such cleanliness requirements in the most effective and cost efficient manner, many facilities, and in particular processing facilities which require regular or daily cleaning, have installed "clean-in-place" systems. These systems are usually permanent, fixed, "hard-piped" systems which operate to clean process systems quickly and without temporary piping, hoses, pumps, and the like.

Typically, clean-in-place systems comprise a number of tanks and associated pumps, automatic and manual valves, and interconnecting piping. The systems generally fall into two broad categories, namely single use systems in which the chemical cleaning agent is used once and discarded after use and multiple use systems in which the chemical cleaning agent is stored after use and subsequently reused for system cleaning. Single use systems can be configured as single tank or multi-tank systems. Such systems may include an eductor pump located at the clean-in-place unit to return the cleaning agent to the system, or motive pump return systems.

An exemplary two tank, eductor pump system includes a wash tank, a rinse tank, and a supply pump for supplying wash or rinse liquid to the vessel being washed. The two tank, eductor pump system also includes a motive tank in addition to the wash and rinse tanks, as well as a motive pump to provide dynamic head for the eductor. Thus, such a two tank, eductor pump system requires three tanks and two pumps, besides an eductor.

An exemplary, two tank, return pump system includes a wash tank, a rinse tank, a supply pump, and a return pump. The supply pump supplies the wash or rinse liquid to the vessel to be cleaned and the return pump returns the contaminated liquid from the vessel to the clean-in-place system. Return pump systems are more prevalent in those industries which use clean-in-place systems.

Three tank systems are designed and operated similarly, except that, in general, the additional tank provides the ability to supply an acid or a caustic solution to the vessel, as required for a particular application.

Clean-in-place systems are cost effective. Operating time for the clean-in-place system and downtime for the process system are minimized because clean-in-place systems are permanently installed to the processing system. Moreover, clean-in-place systems provide superior results as compared to manual cleaning. Thus, clean-in-place systems provide a more effective and flexible cleaning process with respect to time and cleanliness.

Nevertheless, there are some disadvantages associated with presently used clean-in-place systems. Clean-in-place systems which are currently used in industry can be cost intensive. The equipment, including tanks, pumps, valves, controls, and piping may be costly to purchase, particularly since such systems are fabricated, totally or in part, from stainless steel, or the like. Moreover, equipment costs for tanks, pumps, valves, and controls are often only a fraction of the cost for installing such equipment.

Additionally, operating costs for multi-tank clean-in-place systems can be high. Such operating costs include the cost of chemical cleaning agents which can be particularly high for single use systems in which the cleaning agent is used once and discarded. Further costs to be considered are those associated with providing supply water for the cleaning operation, as well as those associated with processing waste water. Given that the multi-tank systems are generally large volume based systems, the overall chemical cleaning agent and water costs can accumulate quickly.

Accordingly, clean-in-place systems are provided which use a single recirculation pump to provide vessel supply or feed solution and to return contaminated vessel wash solution, and which systems do not require, under most conditions, require additional tankage. Such systems minimize the initial cost of purchasing and installing an equipment intensive clean-in-place system, and further minimize the amount of chemical cleaning agent required to clean the vessels and piping systems by eliminating, to the extent possible, excess tankage. Moreover, the elimination of excess tankage also results in minimized water use and waste water processing.

SUMMARY OF THE INVENTION

A single motive pump, clean-in-place system is provided for use with an associated piping system and with a vessel to be cleaned of contaminating material, the vessel having a discharge outlet at substantially the bottom of the vessel and having an inlet for providing a liquid to the vessel.

The system has a recirculation loop for providing flow communication and includes a recirculation pump, an eductor pump, and a separator. The recirculation pump, which is a motive pump, is arranged to discharge a liquid through the eductor into the separator and is supplied with liquid from the separator.

A return line provides flow communication between the discharge outlet of the vessel to be cleaned and the eductor pump. The recirculation pump causes liquid flowing through the recirculation loop to have a sufficient dynamic head at the eductor pump to draw liquid from the discharge outlet of the vessel through the return line.

A feed line including a feed line valve provides flow communication between the recirculation loop and the vessel inlet when the feed line valve is opened. The recirculation pump is arranged to provide a generally continuous flow of liquid through the feed line into the vessel at a generally constant velocity to clean the vessel.

The liquid entering the vessel through the inlet and the liquid discharged from the vessel through the return line are dynamically balanced to minimize pooling of the liquid within the vessel, and to suspend contaminating material in the liquid within the vessel, and to carry off the suspended contaminating material from the vessel through the return line.

The clean-in-place system further includes a liquid supply to the system. The liquid supply to the system is preferably a liquid supply line.

In a preferred embodiment, the clean-in-place system separator has a discharge port for discharging air which is entrained in the liquid discharged from the eductor, and for discharging contaminating material which is suspended in the liquid. A vacuum breaker is operably connected to the discharge port.

Optionally, the clean-in-place system further includes a heat exchanger in the feed line.

In an alternate embodiment, the clean-in-place system has a liquid supply tank for supplying liquid to the system.

These and other objects, features, and advantages of this invention are evident from the following description of several embodiments of this invention with reference to the accompanying drawings.

DETAILED DESCRIPTION OF THE ILLUSTRATED EMBODIMENTS

Figure 1:
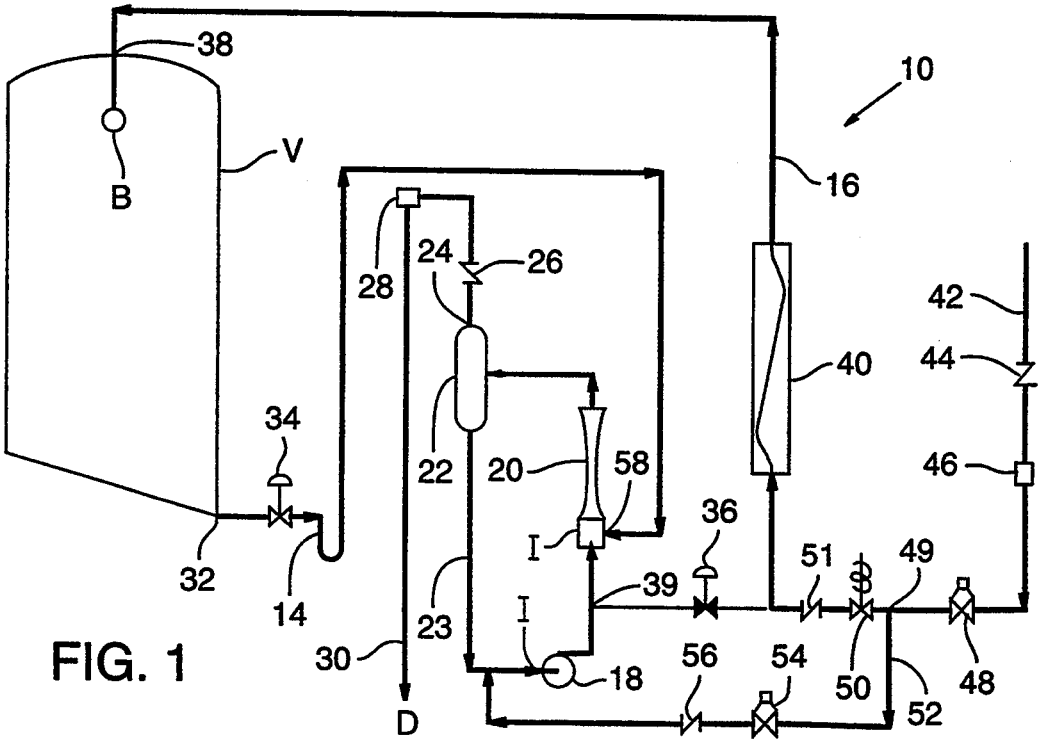
FIG. 1 is a simplified flow diagram of one exemplary clean-in-place system operating in the rinse cycle mode, which system embodies the principles of the present invention, and which operates from a direct supply water.

With reference now to the drawings, and particularly to FIG. 1, there is shown an embodiment of the clean-in-place system 10 of the present invention which comprises, generally, a recirculation loop 12, a return line 14, and a feed line 16. The system 10 is used in association with a vessel, such as the exemplary vessel V, to be cleaned of contaminating material.

The recirculation loop 12 includes a recirculation pump 18, which is a motive pump, as well as an eductor pump 20 and a separator 22. The loop 12 is configured such that the recirculation pump 18 discharges into and through the eductor pump 20. The outlet of the eductor pump 20 is directed to the separator 22. The outlet stream 23 from the separator 22 is routed to feed the recirculation pump 18. Interconnecting piping provides flow communication between each the recirculation pump 18 and eductor pump 20, the eductor pump 20 and the separator 22, and the separator 22 and the recirculation pump 18.

A brief explanation of the eductor pump is to be next provided, the details and applications of which will be readily understood by those skilled in the art. It is to be understood that the eductor pump, as a component, is outside of the scope of the present invention.

Generally, the eductor pump has three ports, namely, an inlet port at one end, a discharge port at the opposite end thereof, and a suction port disposed therebetween. Typically, the suction port enters the eductor body so as to be substantially perpendicular to the flow path between the inlet and outlet ports. A nozzle is disposed between the inlet and outlet ports adjacent to, and upstream of, the suction port. In operation, a high pressure liquid is pumped, such as by a centrifugal pump, into the inlet port. The liquid flows through the nozzle and discharges from the eductor at the discharge port. The pressure drop at the nozzle causes a low pressure region immediately downstream thereof in the area of the suction port. The low pressure region creates a driving force for the liquid at the suction port to enter the eductor, mix with the flowing liquid in the low pressure region and be carried out of the eductor with the flowing liquid through the discharge port.

In this embodiment, the eductor 20 is installed such that the recirculation pump 18 discharges into the eductor 20 inlet port. The discharge from the eductor 20 outlet port is directed to the separator 22. The eductor suction port, shown at 58, is connected to the return line 14.

The separator 22 has a discharge port 24, connected to a check valve 26, a vacuum breaker 28 operably connected to the separator 22, and a discharge line 30. The discharge line is routed to a drain D or other overflow or drainage area. In an embodiment of the system 10, the separator 22 inlet from the eductor 20 is tangentially configured so as to impart a swirling motion to the entering fluid. The swirling motion facilitates separating the entering liquid from any air which may be entrained in the liquid.

The return line 14 is routed from the vessel V discharge outlet 32. The discharge outlet 32 may take many forms, and is illustrated in FIG. I as a bottom discharge in a sloped bottom vessel. However, the discharge may alternatively be a side discharge port or a siphon port, depending upon vessel V construction. Typically, process line valve 34 is located in the return line 14 for process operations. The return line 14 is connected to the eductor pump 20 at the eductor suction port, as shown at 58.

The feed line 16 provides flow communication between the recirculation loop 12 and the vessel inlet 38. The feed line 16 extends from a point on the recirculation loop 12 between the recirculation pump 18 and the eductor pump 20, as indicated at 39. The feed line 16 includes a feed valve 36 and optionally includes a heat exchanger 40, as required by the particular application.

Ancillary to the system 10, in one embodiment of the system 10, a supply line 42 provides the rinse cycle flow and the initial volume of wash liquid necessary for operation of the system 10. The supply line 42 includes a check valve 44, a vacuum breaker 46, a pressure regulating valve 48, an on-off valve 50, exemplary of which is the solenoid operated valve shown, and an additional check valve 51. A priming line 52 extends from the supply line 42 to the recirculation pump 18, from a point on the supply line 42 between the pressure regulating valve 48 and on-off valve 50, as indicated at 49. The priming line includes a pressure regulating valve 54 and a check valve 56.

It is contemplated that water will be the primary liquid used to rinse the vessel, as well as the primary constituent or diluent of the cleaning agent for cleaning the vessel or other piping and components. It is further contemplated that at least one injection point, and alternatively various injection points, will be installed to facilitate the introduction of cleaning agents into the system 10. Exemplary injection point locations are indicated at I in FIG. 1.

The present invention contemplates that the exemplary system 10 will be operated in two modes, namely, a rinse cycle mode and a wash recirculation mode. The rinse cycle mode is shown in FIG. 1 in which the liquid flow path is indicated by darkened arrows, by operable valves which are open when shown unshaded, and by conversely operable valves which are closed when shown shaded.

With reference to FIG. 1, water is first used to prime the recirculation loop 12. A portion of the water from the supply line 42 is directed through the priming line 52, the pressure regulating valve 54, and the check valve 56, into the recirculation pump 18 feed line. The pressure in the priming line is maintained sufficiently high to raise the water level in the system 10, to the separator 22. When the recirculation loop 12 is primed, the recirculation pump 18 is started.

When the recirculation pump 18 is started, water flows through the recirculation loop; that is, water is discharged from the recirculation pump 18, through the eductor pump 20, and to the separator 22. Again, some of the water flows down, out of the separator 22, so as to provide a supply of water, relatively free of entrained air, to the recirculation pump 18. Excess water which may later enter the recirculation loop 12 flows out of the separator 22 through the discharge 24.

Contemporaneous with starting the recirculation pump 18, water is supplied to the system 10 through the supply line 42. The water flows through the check valve 44, the vacuum breaker 46, and the pressure regulator 48. The water then flows through the on-off valve 50 and the check valve 51 into a portion of the feed line 16. The feed valve 36 is closed which directs the water through heat exchanger 40, to the vessel inlet 38 and into the vessel V.

The water which flows through the feed line 16 is directed to a distribution header, such as the exemplary spray ball B shown in FIG. 1, which distributes the water in the vessel, principally directing the water toward the top and the upper sides of the vessel, from where, upon contact with the vessel walls, the water flows down the sides thereof and flows across the bottom of the vessel V to the discharge 32, without pooling in the vessel V.

The water is then discharged from the vessel V through the discharge 32 and into the return line 14. The water flows through the process valve 34, through the eductor pump 20, and into the separator 22. Some of the water flows out of the separator 22, through the separator discharge 24, the check valve 26, and the vacuum breaker 28, to the drain D. The remaining water flows downward in the separator to feed the recirculation pump 18. Since the recirculation loop 12 is in a steady flow condition, the flow rate of water out of the separator 22 which is directed to the drain D is equal to the flow rate of water input to the recirculation loop 12 from the return line 14.

When the recirculation pump 18 is operating, water is pumped through the inlet of the eductor pump 20. Water flowing through the eductor pump 20 hydrodynamically drives water through the return line 14 from the vessel V; that is, water is drawn through return line 14 into the suction port 58 of the eductor 20 from the vessel V.

In the rinse cycle mode, the flow rate of water supplied to the system is maintained at a level so as to minimize water use. This is the optimum cleaning flow rate. Water is supplied to the vessel V through feed line 16 and into vessel inlet 38. The water is distributed internally, over the top and the upper sides of the vessel V by the spray ball B. The water flows over the sides of the vessel V and is discharged from the vessel V through the discharge 32. The spraying action from ball B and the consequent water flowing over the top and the sides of the vessel V washes away contaminating material which has collected on the sides and the bottom of the vessel V.

Moreover, the system 10 is dynamically balanced so that water does not pool at the bottom of the vessel V. This is done by oversizing the eductor 20 so that all of the water which is received at the discharge 32 is immediately drawn out to the eductor suction port 58. The eductor 20 is oversized in that it is designed to accommodate a flow rate greater than the flow rate which it will experience during actual operation of the system 10. Essentially, the system 10 is balanced in such a manner that the vessel V appears to be empty when the system 10 is in operation. Water which flows to the bottom of the vessel V is returned to the recirculation loop 12 through the return line 14. Because the amount of water in the system 10 is minimized, and because the flow rate of water through the system is maintained sufficiently high to eliminate water pooling in the vessel V, contaminating material which is stripped from the vessel walls cannot settle in the vessel V. Rather, the contaminating material that is removed by flushing the vessel V with the flowing water is drawn out of the vessel V to the recirculation loop 12. Furthermore, maintaining the flow rate of the water in the system 10 at a high level prevents the contaminating material from settling within the system 10 or vessel V. Rather, the contaminating material is forced out of the system 10 to a drain D.

The present system uses an eductor pump which provides a number of benefits over motive pumps. One such benefit is that, unlike a motive pump, an eductor pump is not adversely affected, or even damaged, by the introduction of entrained air in the water supply to the pump. Thus, the present system is configured so that the eductor pump, which takes suction from the return line, may in fact draw some air from the vessel V. The advantage of this arrangement is that it compliments the dynamic balance of water flowing in the system, as well as the objectives of maintaining the vessel level low and minimizing the overall water usage.

The mixture of water and entrained air in the return line 14 flows to the eductor pump suction port 58, at which the water and entrained air are intermixed with the water flowing through the eductor pump 20 from the recirculation loop 12. The eductor pump 20 discharges to the separator 22. In the separator 22, water, due to gravitational forces, falls to the bottom and provides a supply of water, relatively free of entrained air, to the recirculation pump 18. The mixture of entrained air and water flows out of the top of the separator 22, through check valve 26, and through vacuum breaker 28, and is directed out of the system 10, through discharge line 30, to the drain D.

Figure 2:
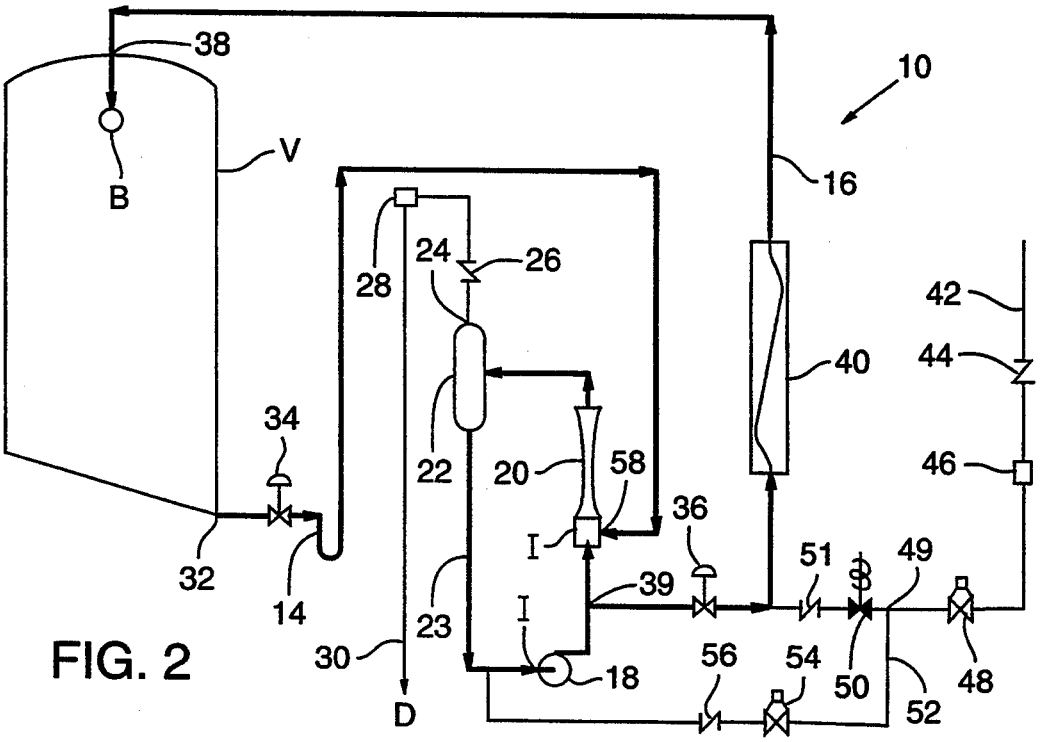
FIG. 2 is a flow diagram of the clean-in-place system of FIG. 1 in which the system is operating in the wash recirculation mode.

Once the rinse cycle is complete and the contaminating material has been flushed out of the vessel V and piping, the system 10 is placed in the wash recirculation mode, as shown in FIG. 2, in which the liquid flow path is indicated by darkened arrows by operable valves which are open when shown unshaded, and by conversely operable valves which are closed when shown shaded.

In the wash recirculation mode, a chemical cleaning agent ("detergent") is added to the system at exemplary injection points indicated at I in FIG. 2. The system 10 operates in much the same manner as in the rinse cycle mode, except that the supply line 42 is isolated, and except that the dynamic balance of the system 10 is such that detergent is not discharged from the top of the separator 22.

Detergent is drawn from the vessel V from discharge 32 through return line 14 and to recirculation loop 12. Recirculation pump 18 discharges detergent through eductor pump 20 and into separator 22. The liquid level in the recirculation loop 12 is maintained, by water from the supply line 42 if necessary, so that the static water pressure in the loop 12 is equal to the level of the separator 22. The flow of detergent through the eductor pump 20 hydrodynamically drives or draws detergent from the return line 14, into the eductor 20, through the suction port 58. In the separator, detergent, by gravitational forces, falls to the bottom to provide a supply of liquid and detergent, relatively free of entrained air, to the recirculation pump 18. Air which may have been entrained is separated from the liquid, in the separator 22, and is discharged therefrom through the discharge line 30. Since the recirculation loop 12 is in a steady flow condition, it is contemplated that the flow of detergent out of the separator 22 will be directed to the recirculation pump 18, and that entrained air will be directed to the drain D.

A portion of the liquid and detergent discharged from the recirculation pump 18 flows to the feed line 16 through the open feed valve 36. As necessary, the liquid and detergent are heated in the optional heat exchanger 40 prior to flowing into the vessel V. The liquid and detergent flow into the vessel V through vessel inlet 38 and are distributed over the top and the upper walls of the vessel V by spray ball B. The liquid and detergent flow down the walls and across the bottom of the vessel V and flow to the discharge 32.

The dynamic balance of the system 10 while operating in the wash recirculation mode is similar to that described above in the rinse cycle mode. Since the detergent is supplied to the vessel V at the optimum cleaning flow rate, that is, the level of detergent in the vessel V is kept to a minimum, there is no pooling of detergent at the bottom of the vessel V. Detergent which flows to the bottom of the vessel V is returned to the recirculation loop 12 through the return line 14. Because the amount of detergent in the system 10 is minimized, the overall detergent usage is considerably less than that which would be required for other, single use, multi-tank, clean-in-place systems. The result is a significant cost savings due to reduced detergent requirements and waste management costs.

The present system is also provided with a number of check valves and vacuum breakers to prevent back-flow of water into the water supply through supply line 42, to prevent back-flow of the waste drains from the drain D into the system 10, and to preclude creating a low pressure condition in the recirculation loop 12.

The check valves 44, 51 prevent back-flow to the water supply from the system 10, and vacuum breaker 46 prevents a vacuum or low pressure condition in the water supply from drawing water from the system 10 back to the water supply. The check valve 56 prevents backflow from the recirculation loop 12 to the water supply line 42. The check valve 26 prevents back-flow from the drains D to the separator 22. The vacuum breaker 28 prevents a vacuum condition in the separator 22 from drawing waste from the drain D into the separator 22. The vacuum breaker 28 also prevents water which is flowing into the drain D from creating a low pressure condition in the recirculation loop 12.

Figure 3:
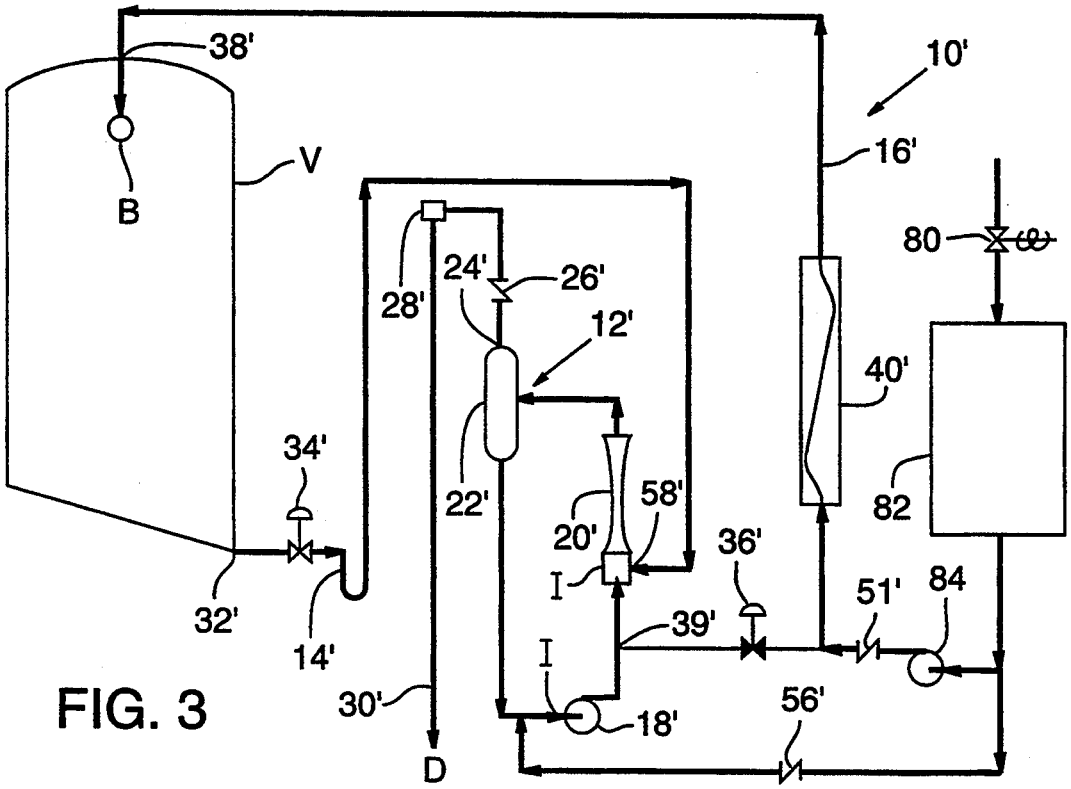
FIG. 3 is a flow diagram of an alternate clean-in-place system operating in the rinse cycle mode, which system operates from a stored water tank.
Figure 4:
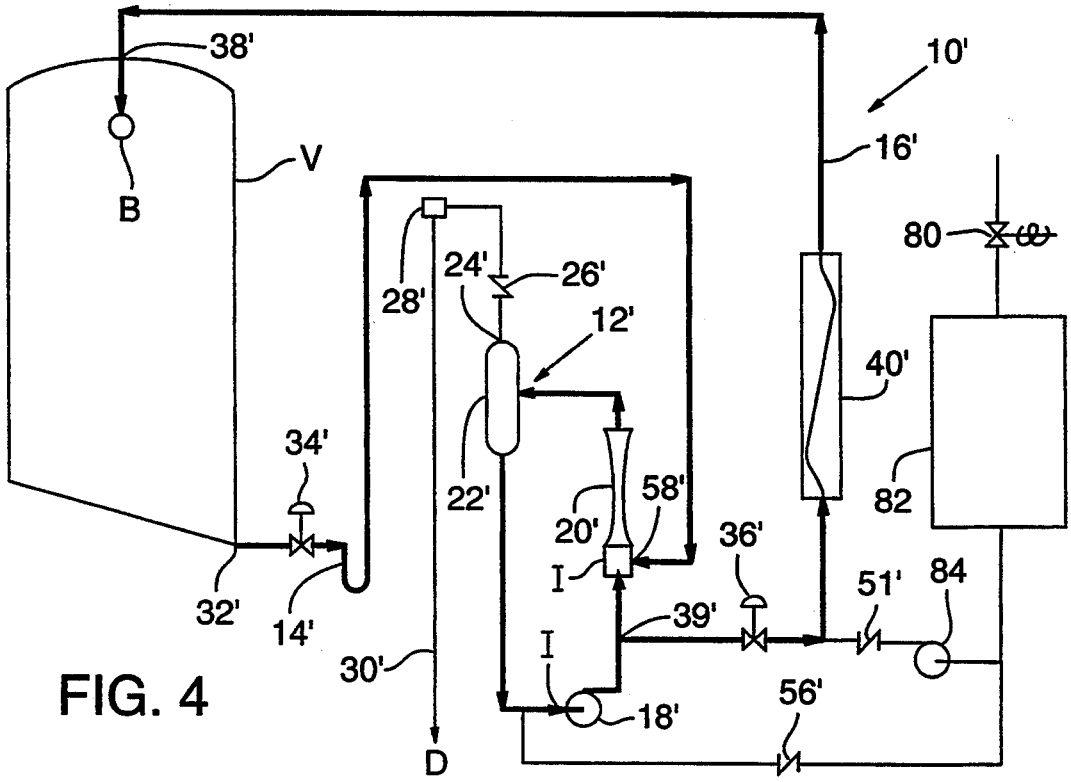
FIG. 4 is a flow diagram of the clean-in-place system of FIG. 3 in which the system is operating in the wash recirculation mode.

An alternate embodiment of the clean-in-place system is shown in FIGS. 3 and 4, which represent flow diagrams similar to FIGS. 1 and 2, and in which the rinse cycle mode is shown in FIG. 3 and the wash recirculation mode is shown in FIG. 4. In the embodiment illustrated in FIGS. 3 and 4, items like those shown in FIGS. 1 and 2 are indicated by like, primed (') numerals in FIGS. 3 and 4.

With reference now to FIG. 3, there is shown an alternate embodiment of the clean-in-place system 10' operating in the rinse cycle mode. The system 10' comprises, generally, a recirculation loop 12' a return line 14', and a feed line 16', and operates in a manner similar to the manner wherein the embodiment of the system 10 shown in FIG. 1 operates, except for the water supply to the system 10'. The FIG. 3 embodiment, which uses a supplied water storage tank 82, is necessary for facilities which have neither sufficient water flow rate nor sufficient water pressure adequately to provide rinse cycle water to the system 10'. The water storage tank 82 serves as a water supply for priming the recirculation loop 12.

Water is initially supplied to the system 10' from a water storage tank 82. The water can be continuously fed into the tank 82 from water supply valve 80. Alternatively, water can be stored in the tank 82 for use as needed. The supply valve 80 is an on-off type valve, such as the exemplary solenoid-operated valve shown.

The recirculation loop 12' is first primed and the recirculation pump 18' is started. Contemporaneous with starting the pump 18' water is pumped into the system 10', at the feed line 16', from an auxiliary water supply pump 84. The pump 84 is needed only during the rinse cycle During operation of the system 10', water from the water storage tank 82 may be used to supply water to the system 10' to account for any liquid losses from the system 10' during operation. As necessary for the application, the water supply may be heated in optional heat exchanger 40'.

The remaining portions of the FIG. 3 system operate in like manner to the embodiment shown in FIG. 1. Water is drawn from the vessel V, through the return line 14', to the recirculation loop 12'. Water is pumped in the recirculation loop 12', from the recirculation pump 18', through the eductor pump 20', to the separator 22'. The flow of water through the eductor pump 20' hydrodynamically drives or draws water from the vessel V, into the eductor suction port 58', through the return line 14'.

In the separator 22', water falls to the bottom of the separator 22' and provides a supply of water, relatively free of entrained air, to the recirculation pump 18'. Entrained air and water are discharged from the separator 22', through the separator discharge port 24', and the check valve 26', out to the drain D through discharge line 30'.

Once the rinse cycle is complete, the wash recirculation cycle commences. Importantly, the invention contemplates that the wash recirculation cycle is to commence as the rinse cycle is completed. Operating in this manner provides an uninterrupted flow of water to the vessel V. The feed line valve 36' is opened and the auxiliary water supply pump 84 is isolated. Detergent, or other cleaning agent, may be injected into the system 10' at locations such as the exemplary injection locations I.

A portion of the water discharged from the recirculation pump 18' flows into the feed line 16', through the open feed line valve 36'. The check valve 51' prevents back flow of detergent into the tank 82. The feed water flows into the vessel V through the feed line 16', and through the tank inlet 38'. The water is distributed over the walls of the vessel V by spray ball B. Water pumped through the recirculation loop 12' hydrodynamically drives or draws water from the vessel V, through the return line 14', into the eductor suction port 58'.

The system 10' is provided with a number of check valves and vacuum breakers to prevent back-flow of water into the water storage tank 82 and to prevent back-flow of the waste drains from the drain D into the system 10'.

The check valve 51 prevents back-flow to the water storage tank 82 from the system 10'. The check valve 56' prevents back-flow from the recirculation loop 12 to the water storage tank 82. The check valve 26' prevents back-flow from the drain D to the separator 22'. The vacuum breaker 28' prevents a vacuum condition in the separator 22' from drawing waste from the drain D into the separator 22', and precludes creating a low pressure condition in the recirculation loop 12'.

The present invention provides clean-in-place systems 10, 10', which effectively clean vessels and associated piping systems using a single motive pump to provide sufficient head to drive an eductor pump, and to provide all return flow. Such systems 10, 10', permit cleaning in an efficient and cost effective manner by requiring less chemical cleaning agent then typical single use systems. Moreover, the number of valves, pumps, and tanks generally associated with clean-in-place systems is substantially reduced, which results in capital cost savings.

In an exemplary embodiment, a system 10 was configured to provide a flow rate of 40 gallons per minute ("gpm") to a spray ball B, in a vessel V. The system 10, as configured, was designed to accommodate a flow rate of 60 gpm from the vessel V through the return line 14. The recirculation pump 18 was designed to discharge at a flow rate of 64 gpm to the eductor 20, and the separator 22 was designed to accommodate a combined input flow rate of 124 gpm, from the recirculation pump 18 and the return line 14.

In another exemplary embodiment of the system 10, in which a flow rate of 80 gpm was provided to the spray ball B, the system 10 was configured to accommodate a flow rate of 112 gpm from the vessel V, through the return line 14. The recirculation pump 18 was designed to discharge at a flow rate of 118 gpm to the eductor 20, and the separator 22 was designed to accommodate a combined input flow rate of 230 gpm, from the recirculation pump 18 and the return line 14.

These design parameters are exemplary only and are intended only to be representative of the present invention, and should not in any way be construed to so limit the invention to the embodiments illustrated.

It is contemplated that the present systems 10, 10', may also include various control and monitoring devices such as pressure indicators and switches, flow indicators and switches, and automatic or remotely operated valves and the like. The systems 10, 10' may also be partly or fully operated by automatic control systems which receive signals from such monitoring devices, and consequently transmit control signals accordingly. Moreover, the system 10 may further include pressure or flow monitoring devices at the recirculation pump 18, or an amperage monitoring device on the motor which drives the recirculation pump 18, in order to verify that the recirculation pump 18 is operating within its design parameters.

From the foregoing it will be observed that numerous modifications can be effected without departing from the true spirit and scope of the novel concepts of the present invention. It will be understood that no limitation with respect to the specific embodiments illustrated herein is intended or should be inferred. It is, of course, intended to cover by the appended claims all such modifications as fall within the scope of the claims.

What is claimed is:

1. A single motive pump, clean-in-place system for use with an associated piping system and with a vessel to be cleaned of contaminating material, the vessel having a discharge outlet at substantially the bottom of the vessel and having an inlet for providing a liquid to the vessel, comprising:

a. a recirculation loop for providing flow communication and including a recirculation pump, an eductor, and a separator, the recirculation pump being a motive pump, being arranged to discharge a liquid through the eductor into the separator, and being supplied with liquid from the separator;

b. a return line for providing flow communication between the discharge outlet of the vessel to be cleaned and the eductor, the recirculation pump causing liquid flowing through the recirculation loop to have a sufficient dynamic head at the eductor to draw liquid from the discharge outlet of the vessel through the return line; and c. a feed line including a feed line valve for providing flow communication between the recirculation loop and the vessel inlet when the feed line valve is opened, the recirculation pump being arranged to provide a generally continuous flow of liquid through the feed line into the vessel at a generally constant velocity to clean the vessel;

wherein the liquid entering the vessel through the inlet and the liquid discharged from the vessel through the return line are dynamically balanced to minimize pooling of the liquid in the vessel, to suspend contaminating material in the liquid within the vessel, and to carry off the suspended contaminating material from the vessel through the return line.

2. The clean-in-place system of claim 1 further including means for supplying liquid to the system.

3. The clean-in-place system of claim 2 wherein the means for supplying liquid to the system is a liquid supply line.

4. The clean-in-place system of claim 2 wherein the means for supplying liquid to the system is a liquid supply tank.

5. The clean-in-place system of claim 1 wherein the separator has a discharge port for discharging air which is entrained in the liquid discharged from the eductor, and for discharging contaminating material which is suspended in the liquid, and a vacuum breaker operably connected to the discharge port.

6. The clean-in-place system of claim 1 further including a heat exchanger in the feed line.

* * * * *